US008347580B2

(12) United States Patent
Beeche

(10) Patent No.: US 8,347,580 B2
(45) Date of Patent: Jan. 8, 2013

(54) STRUCTURAL MEMBER AND MODULAR BEAM SYSTEM

(76) Inventor: Gregory L. Beeche, Mechanicville, NY (US)

( * ) Notice: Subject to any disclaimer, the term of this patent is extended or adjusted under 35 U.S.C. 154(b) by 0 days.

(21) Appl. No.: 10/337,938

(22) Filed: Jan. 6, 2003

(65) Prior Publication Data

US 2004/0128942 A1 Jul. 8, 2004

(51) Int. Cl.
*E04C 3/02* (2006.01)

(52) U.S. Cl. ..... 52/697; 52/780; 52/204.67

(58) Field of Classification Search ..... 52/729.1, 52/730.1, 731.1, 731.2, 732.1, 737.1, 697, 52/780, 765
See application file for complete search history.

(56) References Cited

U.S. PATENT DOCUMENTS 3,852,932 A * 12/1974 Mukoyama et al. ..... 52/57
3,877,193 A * 4/1975 Hall ..... 52/665
4,201,026 A * 5/1980 Murphy ..... 52/731.2
4,624,091 A * 11/1986 Biro ..... 52/656.5
5,233,807 A * 8/1993 Spera ..... 52/729.1
5,412,913 A * 5/1995 Daniels et al. ..... 52/79.13
5,464,302 A * 11/1995 Menchetti ..... 403/335
5,499,480 A * 3/1996 Bass ..... 52/653.1
5,553,437 A * 9/1996 Navon ..... 52/729.1
5,680,738 A * 10/1997 Allen et al. ..... 52/729.1
5,729,945 A * 3/1998 Menchetti et al. ..... 52/481.1
5,837,095 A * 11/1998 Bruchu et al. ..... 156/499
5,913,794 A * 6/1999 Chen ..... 52/729.1
6,237,506 B1 * 5/2001 Forbes ..... 105/355
6,341,467 B1 * 1/2002 Wycech ..... 52/721.4
6,415,576 B1 * 7/2002 Stromback ..... 52/719
6,530,560 B2 * 3/2003 King ..... 256/1
6,615,564 B2 * 9/2003 Lutrario et al. ..... 52/765
6,758,627 B2 * 7/2004 King ..... 404/6

* cited by examiner

*Primary Examiner* — Peter Brown
*Assistant Examiner* — Erika Garrett
(74) *Attorney, Agent, or Firm* — Robert J. Jarvis, Esq.

(57) ABSTRACT

An improved structural member includes a pair of top flanges each extending along the member's length in a separated and opposed co-planar fashion, and a pair of similarly separated and opposed co-planar bottom flanges also extending throughout the member's length. At least two web members connect the lowermost surfaces of the top flanges to the uppermost surfaces of the bottom flanges, and at least one leg member connects these web members together and holds them in a spaced-apart relationship. The invention also includes cooperatively configured components for connecting the inventive structural members together in end-to-end and perpendicular relationships, and also strengthening members which may be added to or removed from the structural members, as needed. Additionally, components for attaching the structural members to other mechanisms and to conventional accessories are provided, so that a modular beam and scaffold system is formed.

7 Claims, 8 Drawing Sheets

STRUCTURAL MEMBER AND MODULAR BEAM SYSTEM

FIELD OF THE INVENTION

This invention relates to structural assemblies which may be formed from modular components, so as to provide varying sizes, configurations, and strength characteristics by combining only a limited number of parts. Such assemblies are very useful in the construction and maintenance of buildings, bridges, and other structures. In particular, the invention is directed to an improved structural member which is easily connected to like members and to other components using simple and economical fabrications, and for which the member's span strength and lateral rigidity may be increased by adding cooperating components and thereby forming a "composite" beam.

BACKGROUND OF THE INVENTION

In the building trades, as well as in other industries, it is often necessary to configure a structural assembly in a non-uniform shape and to be able to quickly and easily move the assembly from one location to another. With specific reference to the construction industry, a scaffolding system or frame assembly is typically employed in close proximity to the building or structure being worked on, in order to provide artisans with a suitable area from which to perform their tasks. These tasks cover all aspects of a structure's construction and maintenance, including such diverse activities as applying materials to buildings under construction, washing the windows and exterior surfaces of completed buildings, and sandblasting and repainting the metal surfaces of bridge members.

In the past, scaffolding systems were constructed by bolting together vertical and horizontal members, and were essentially built from the ground up. These scaffolding systems were usually not movable, and therefore allowed access to only one portion of the building or structure at a time. To move on to the next portion of the building, it was usually necessary to disassemble the scaffolding system, relocate its base, and then reassemble the members involved. In addition to requiring a considerable amount of time and energy to dismantle and reassemble the scaffold each time it was moved, these prior art systems also presented significant safety risks to the workers using them. In addition, for most of these prior art scaffolding systems, the vertical height of the work platform could not be raised or lowered without dismantling a substantial portion of the scaffolding system.

Another problem that has become prevalent in modern construction and maintenance activities is the need for scaffolding systems which are readily adaptable in size and shape, and which can be easily configured to accommodate a variety of accessories. As the pace of building construction has increased, and the time available for completing each task has correspondingly decreased, such scaffolding systems have become key elements in the construction process. The variety and complexity of building shapes and structures has increased dramatically in recent years. Designing and fabricating customized scaffolding systems to fit particular building shapes and to accommodate particular tasks can be both time consuming and relatively expensive. Contemporary scaffolding systems must therefore be adaptable for use in many configurations and applications. The assembled platforms must also have sufficient span strength and torsional rigidity to safely hold both the workers using the scaffolding and their materials.

Recently, several scaffolding system improvements have been disclosed which alleviate a number of the problems noted above. U.S. Pat. No. 4,234,055, issued to G. L. Beeche on Nov. 18, 1980, describes a mobile suspension scaffold which requires assembly and dismantling only once for each construction site, at the beginning and the end of the job, respectively. The system described may be moved along the sides of a building and around building corners without being disassembled. A suspended scaffold system which may be used either independently or in conjunction with this mobile scaffold is the folding scaffold described in U.S. Pat. No. 4,253,548, issued to G. L. Beeche on Mar. 3, 1981. The system disclosed therein includes a plurality of work platforms which are foldably linked together. U.S. Pat. No. 4,967,875, issued to G. L. Beeche on Nov. 6, 1990, described a scaffolding system which employs modular components that may be combined to readily provide a variety of scaffold configurations and sizes. U.S. Pat. No. 5,203,428, issued to G. L. Beeche on Apr. 20, 1993, in turn discloses a scaffolding platform comprised of connected truss frames, which platform is particularly useful in conjunction with the scaffolding system disclosed by U.S. Pat. No. 4,967,875, and which may also be used independently thereof. The scaffold platform set forth in U.S. Pat. No. 5,203,428 is itself modular in nature, thereby further facilitating the assembly of scaffolding platforms which can conform to nearly any building size or shape. Finally, U.S. Pat. No. 5,214,899, issued to Beeche et al. on Jun. 1, 1993, describes a truss frame that is assembled from lightweight, modular components which are designed so as to provide the assembled frame with exceptional strength and rigidity.

For these and other commercially available scaffolding systems, the strength provided in the vertical and horizontal directions must be traded off against the amount of material used in the structural members, and, correspondingly, the cost and weight of those members. Another factor which must be considered is the availability and complexity required for components used to attach the scaffolding members to other structures.

In typical scaffolding applications, structural members are subject to both vertical load forces and horizontal deforming forces, produced, in part, by reaction to the load forces. For any given situation, either the vertical and horizontal strength provided by the structural member must be sufficient to withstand such forces, or appropriate additional bracing of the member must be incorporated into the scaffold design.

A cylindrically-shaped tube provides equal strength in the vertical and horizontal directions, so it does not need bracing to increase its horizontal strength. However, most scaffolding applications do not require equal amounts of horizontal and vertical strength, and a cylindrical design is therefore inefficient in that the member includes more metal material in certain locations than is necessary. Furthermore, the cylindrical shape of the member requires the use of special, non-standard accessories for such items as trolleys and building column mounts, which are relatively costly compared to available, off-the-shelf components.

Similarly, a square-shaped tube provides equal strength in both directions. Once again, however, since equal strength is usually not required in both the horizontal and vertical directions, such a member is also an inefficient use of metal material. To remedy that problem, a rectangularly-shaped tube may be formed. Doing so results in a non-symmetrical shape which reduces the modularity of the structural member. More importantly, a square-shaped or rectangularly-shaped tube presents its own difficulties with respect to attaching the members to like members and to other components. For example, in trolley/track applications, it is relatively difficult to attach the member to building columns without interfering with trolley travel.

Conventional I-beams provide significantly higher vertical strength than horizontal strength, and the top and bottom flanges incorporated therein provide better accessibility for attachments. However, because a conventional I-beam uses only a single web member between the flanges, the horizontal strength provided is significantly less than that provided by a square-shaped or rectangularly-shaped tube (both of which essentially have two web members).

What is needed, then, is a structural member which combines the desirable features of each of these prior art devices, one which makes an efficient use of the metal material while providing sufficient strength in both directions, and which provides ready access for connecting both like members and conventional accessories.

Accordingly, it is an object of the present invention to provide an improved structural member having increased horizontal strength compared to conventional I-beams, while utilizing an equivalent amount of material.

It is another object of the present invention to provide a structural member which is readily useable with conventional accessory components, such as trolleys and building infrastructure elements.

It is a further object of the present invention to provide a structural member for which the vertical and horizontal strength thereof may be increased by adding removable, cooperating modular components, so as to form a modular beam system wherein the same standard components are useable for multiple applications requiring varying member strengths.

It is also an object of this invention to provide a structural member which is readily and easily attachable to like members, both in an end-to-end relationship and in a perpendicular relationship.

It is an additional object of the present invention to provide a structural member and associated components which may be assembled in a modular fashion to form scaffolding systems having varying shapes, sizes, and strength characteristics.

SUMMARY OF THE INVENTION

The structural member of the present invention comprises a pair of top flanges which each extend along the length of the member in a separated and opposed co-planar fashion, and a pair of similarly separated and opposed co-planar bottom flanges which also each extend throughout the member's length. At least two web members connect the lowermost surfaces of the top flanges to the uppermost surfaces of the bottom flanges, and at least one leg member is disposed so as to connect the web members together in a spaced-apart relationship with respect to each other. In an especially useful embodiment, two leg members are used, the web members and the leg members each extend throughout the length of the structural member, and the web members and leg members are further disposed so as to form a rectangular central channel which extends along the length of the structural member, as well as two generally rectangularly-shaped slots which each extend in the same direction, with one of these slots located above the central channel and the other located below it.

The present invention further comprises cooperatively configured components which may be utilized to connect the inventive structural members together in end-to-end and perpendicular relationships, and also strengthening members which may be added to or removed from the structural members, as needed. The invention additionally includes components for attaching the structural members to other mechanisms and to conventional accessories, so as to provide a modular beam and scaffold system which is useful in many applications.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE PREFERRED EMBODIMENTS

Figure 1:
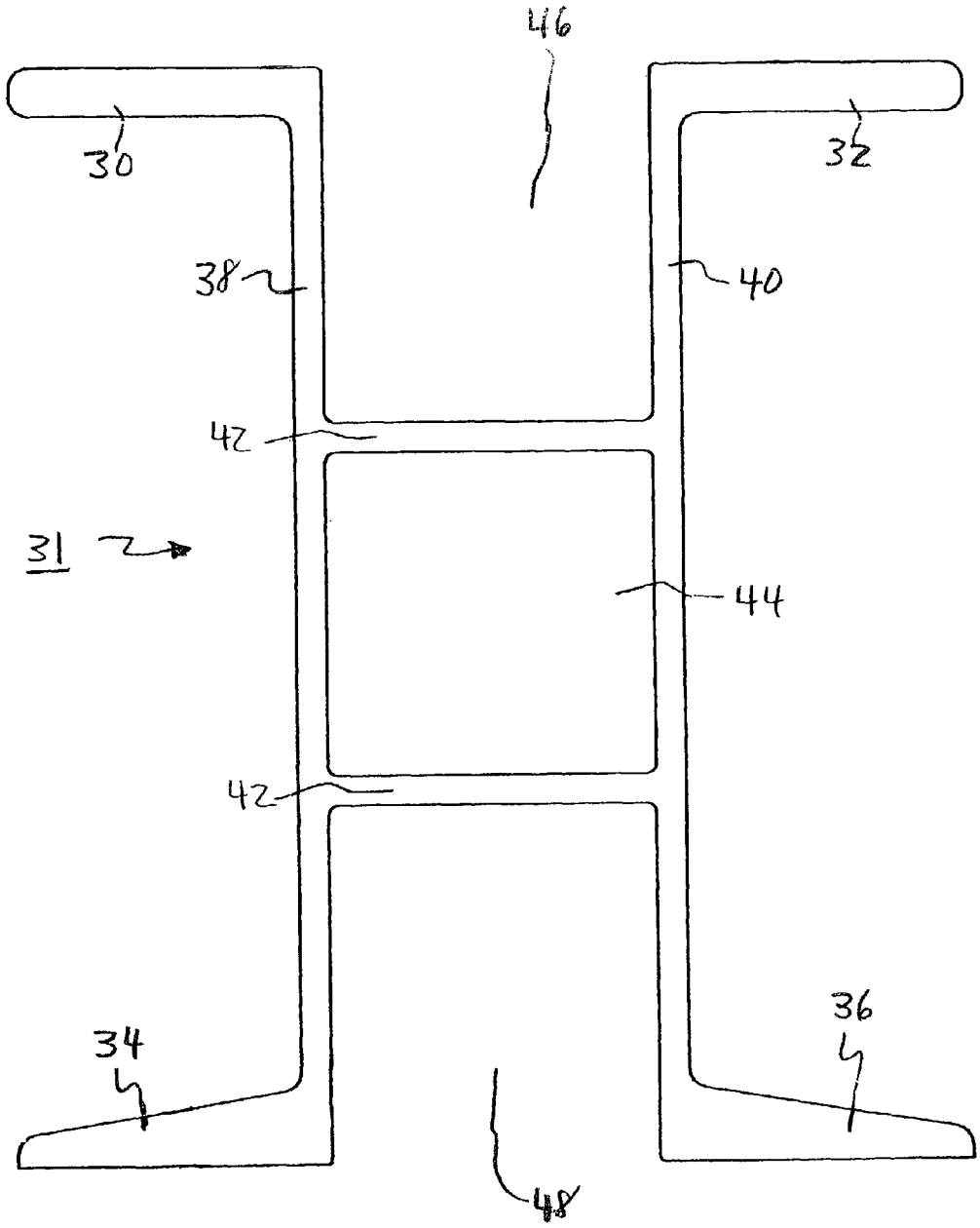
FIG. 1 is a end view of one embodiment of the improved structural member of the present invention.
Figure 2:
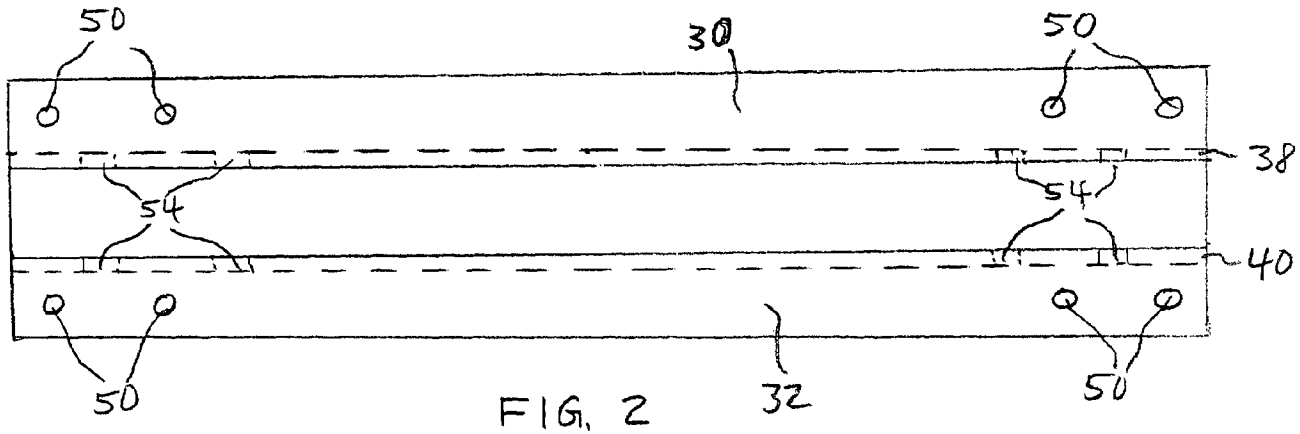
FIG. 2 is a top view of the structural member illustrated in FIG. 1.
Figure 3:
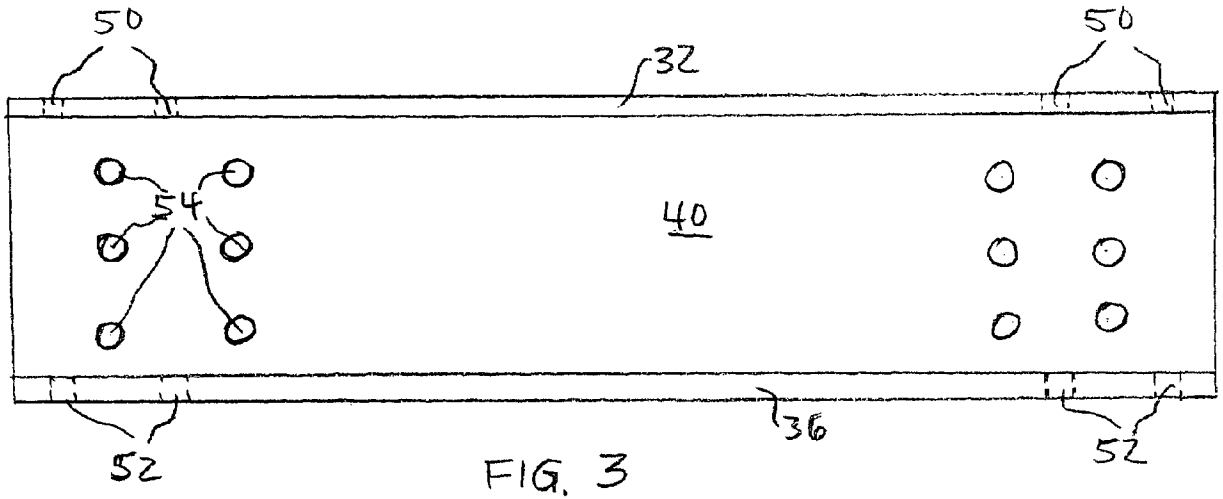
FIG. 3 is a side-elevational view of the structural member illustrated in FIGS. 1 and 2.
Figure 5:
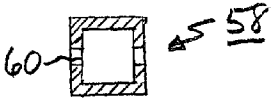
FIG. 5 is a cross-sectional view of the end connector shown in FIG. 4, taken along line 5-5.
Figure 4:
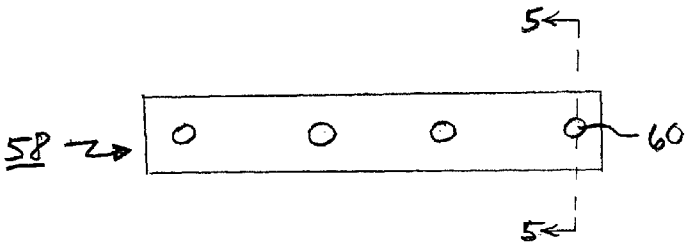
FIG. 4 is a side-elevational view of one embodiment of an end connector which may be used to connect, in an end-to-end relationship, a pair of the structural members illustrated in FIGS. 1-3.
Figure 7:
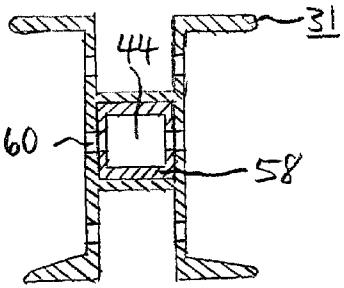
FIG. 7 is a cross-sectional view of the assembly shown in FIG. 6, taken along line 7-7.
Figure 6:
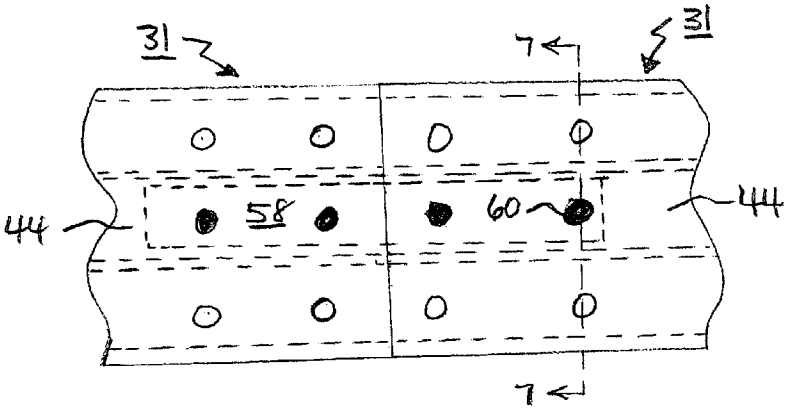
FIG. 6 is a side-elevational view schematically illustrating, in an assembled condition, the end connector of FIG. 5 and a connected pair of the structural members shown in FIGS. 1-3, in accordance with one embodiment of the present invention.

As is schematically illustrated by FIGS. 1-3, the improved structural member 31 of the present invention comprises a pair of top flanges 30 and 32 which are disposed so as to be generally co-planar, and which extend throughout the length of structural member 31. Flanges 30 and 32 are further configured so as to be separated within their plane, and located so as to be opposite one another similarly disposed and configured are bottom flanges 34 and 36, which also each extend throughout the length of structural member 31. Bottom flanges 34 and 36 are separated and oppositely located in the same manner as top flanges 30 and 32.

Member 31 further comprises web member 38 which serves to connect the lowermost surface of top flange 30 with the uppermost surface of bottom flange 34, and to hold said flanges in a spaced-apart relationship. Web member 40 similarly connects and holds top flange 32 and bottom flange 36.

At least one leg member 42 is disposed between web members 38 and 40 so as to connect web members 38 and 40 together and to hold them in a spaced-apart relationship. In the embodiment illustrated by FIG. 1, two such leg members 42 are utilized. In the embodiment shown in FIGS. 2 and 3, web members 38 and 40 and leg members 42 each extend throughout the length of member 31.

For the embodiment illustrated by FIGS. 1-3, web members 38 and 40 are further disposed so as to each extend generally perpendicularly between top flanges 30 and 32 and bottom flanges 34 and 36. In addition, leg members 42 are further configured so as to extend generally perpendicularly between web members 38 and 40. With these structural elements arranged in the illustrated fashion, web members 38 and 40 and leg members 42 together form central channel 44 which extends in a direction along the length of structural member 31, and which has a rectangular cross-sectional shape. Also formed are slots 46 and 48 which each extend along the length of structural member 31. The cross-sectional shape of slots 46 and 48 is also generally rectangular for the embodiment illustrated in FIGS. 1-3. Slot 46 is located above channel 44, and slot 48 is located below said channel.

As can be seen from FIG. 1, most of the metal material for structural member 31 is located at the top and bottom flange areas, which characteristic gives member 31 high strength in the vertical direction. However, in contrast to a conventional I-beam, member 31 has two web members 38 and 40 which are spaced apart by leg members 42. In this arrangement, for the same amount of metal found in the two web members as would be located in the single web of a conventional I-beam, and with the two web members being separated by the length of leg members 42, the inventive structural member provides significantly increased horizontal strength over that exhibited by a conventional I-beam. Indeed, in some respects, the structural member illustrated in FIG. 1 is a combination of an I-beam shape with a rectangular or square tube. Hence, the inventive structural member combines the desirable horizontal strength characteristics of a tube with the desirable vertical strength characteristics and accessibility provided by an I-beam, while also facilitating connections using channel 44 and slots 46 and 48, as will be described below. If needed, additional strength could be obtained by moving legs 42 closer to the adjoining top and bottom flanges, respectively. Alternatively, as will be described in conjunction with FIGS. 6-10, strengthening components may be added to channel 44 and/or slots 46 and 48.

In the preferred embodiment illustrated by FIG. 1, bottom flanges 34 and 36 are further disposed so that the uppermost surfaces are said bottom flanges slope downwardly and outwardly with respect to each other. With bottom flanges 34 and 36 configured in this manner, a trolley assembly rolling along the length of member 31 will tend to align itself with the central vertical axis of member 31. In order to maintain symmetrical vertical strength characteristics, the cross-sectional area of bottom flange 34 may be configured to be equal to the cross-sectional area of top flange 30, and a similar configuration may be chosen for bottom flange 36 and top flange 32.

As illustrated in FIGS. 2 and 3, member 31 further comprises openings 50 formed in top flanges 30 and 32, and similar openings 52 formed in bottom flanges 34 and 36. Openings 50 and 52 all extend in a vertical direction. In contrast, openings 54 are formed in web members 38 and 40, and each extend in a horizontal direction. In addition, the location of openings 50 and 52 is staggered along the length of member 31 with respect to the location of openings 54, so that there is no interference when fastening pins are inserted through any of these openings.

Schematically illustrated in FIGS. 4-7 is one embodiment of an end connector which may be utilized to connect two structural members 31 together in an end-to-end relationship. In the embodiment shown, end connector 58 comprises a rectangularly-shaped tube, the exterior dimensions of which are chosen to snugly fit within the interior dimensions of central channel 44. Four openings 60 extend in a horizontal direction through end connector 58, with the spacing between openings 60 chosen to match the spacing between openings 54 in web members 38 and 40. In operation, end connector 58 is inserted into channel 44 of one of members 31, in such a manner that openings 54 and 60 are aligned. Fasteners are then inserted through the aligned openings, and, in that manner, attach one end of connector 58 to one of members 31. The opposite end of connector 58 is then inserted into channel 44 of the other member 31, the horizontal openings in the two components are aligned, and fastener pins are inserted.

With end connector 58 inserted into channel 44 in the manner illustrated, and with fasteners inserted through corresponding openings 54 and 60 so as to "pin" the two adjoining ends of members 31 together, this end-to-end connection between members 31 serves to continue the condition of top flanges 30 and 32 being in compression and bottom flanges 34 and 36 being in tension, when member 31 is subjected to a vertical load.

Figure 8:
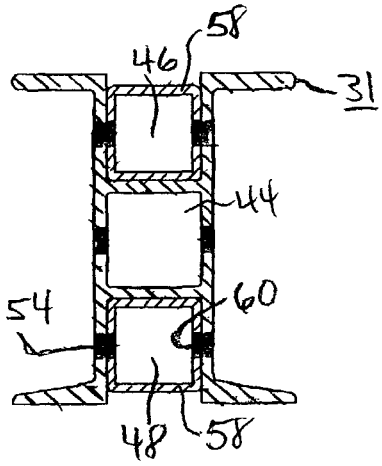
FIG. 8 is a cross-sectional view schematically illustrating an alternative embodiment to that shown in FIGS. 6 and 7, in which embodiment two end connectors are utilized to connect a pair of structural members in an end-to-end relationship.

In the alternative embodiment schematically illustrated by FIG. 8, two such end connectors 58 are utilized, with one located in slot 46 and the other located in slot 48. Since this arrangement adds metal material to the top and bottom flange areas, it provides increased strength over the embodiment illustrated in FIG. 7. Of course, for even greater strength, a third end connector 58 may be inserted into channel 44 in the manner shown in FIG. 7.

Figure 9:
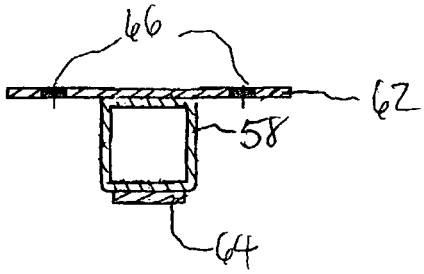
FIG. 9 is a cross-sectional end view schematically illustrating yet another embodiment of an end connector which may be employed to connect a pair of structural members in an end-to-end relationship, in accordance with the present invention.

FIG. 9 schematically illustrates yet another embodiment for end connector 58 which exhibits even greater strength. In this embodiment, plate 62 is attached to the top surface of end connector 58, and plate 64 is connected to the bottom surface thereof. The width of plate 66 is chosen to match the overall width of top flanges 30 and 32 (or bottom flanges 34 and 36 if connector 58 is used at the bottom of structural member 31).

Figure 10:
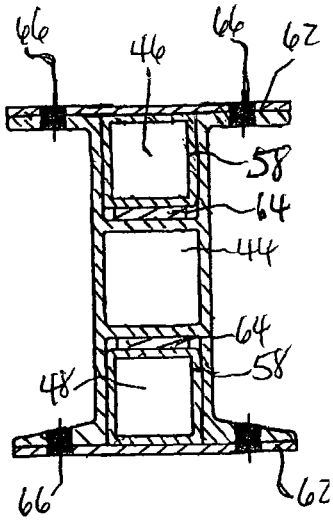
FIG. 10 is a cross-sectional end view showing the end connector of FIG. 9 assembled to the structural member illustrated in FIGS. 1-3.

Plate 66 has formed therein openings extending in a vertical direction, with said openings being configured and located so as to match openings 50 and 52 formed in top flanges 30 and 32 and bottom flanges 34 and 36, respectively. Plate 64 is configured so as to fill any unoccupied space in slots 46 and 48. In operation, either one or both of connectors 58 shown in FIG. 10 are inserted into slots 46 and 48 so that the vertical openings and the horizontal openings in connector 58 are aligned with the corresponding openings in structural member 31, and fasteners are inserted through the aligned openings. For such an embodiment, adjoining members 31 are attached both through the flange members and through the web members, resulting in a very rigid connection.

Of course, for all of the arrangements shown in FIGS. 6-10, connector 58 may be increased in length so as to extend along the entire length of member 31. Doing so with any of the end connectors shown results in a "composite" beam arrangement having increased strength over a structural member without such reinforcement. Depending upon the strength needed, connector 58 may be used in channel 44, two or three connectors 58 may be used in channel 44 and in slots 46 and 48, or a combination of the connectors shown in FIGS. 6-10 may be utilized to meet the strength requirements of any given application. Moreover, when that application is finished, the added structural components may be removed, so that structural member 31 represents the basic building block once again.

Figure 12:
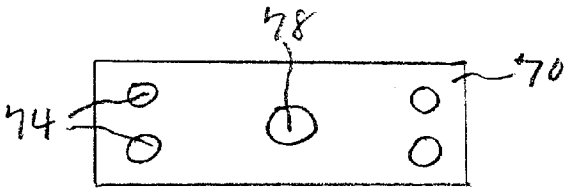
FIG. 12 is a top view of the clamping plate included in the top connector assembly shown in FIG. 11.
Figure 11:
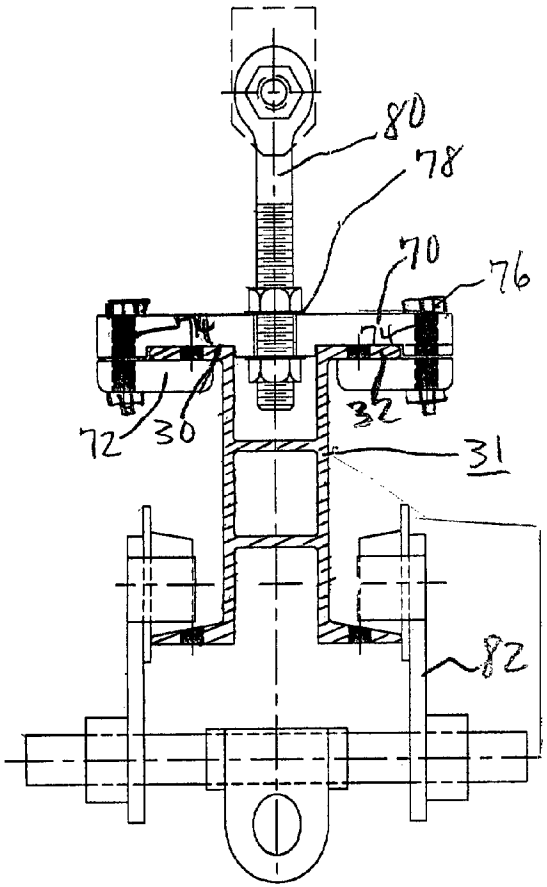
FIG. 11 is an end view, in partial cross-section, schematically illustrating one embodiment of a top connector which may be used to attach the top flange of the structural member shown in FIGS. 1-3 to a supporting apparatus, in accordance with the present invention.

FIGS. 11 and 12 schematically illustrate one embodiment of a connector which may be utilized to attach member 31 to a supporting structure located above member 31. As shown therein, such a connector may comprise top clamping plate 70 disposed on the top surface of top flanges 30 and 32, and bottom clamping plates 72 disposed on the bottom surfaces of flanges 30 and 32. Openings 74 are formed in both top plate 70 and bottom plates 72, and fasteners 76 are inserted through said openings so as to clamp the two plates together. Also formed in plate 70 is opening 78 through which jawbolt 80 may be fastened to plate 70. The top end of jawbolt 80 is attached in a suitable fashion to a supporting structure. In the monorail application illustrated by FIG. 11, trolley 82 rides along the uppermost surfaces of bottom flanges 34 and 36.

Figure 13:
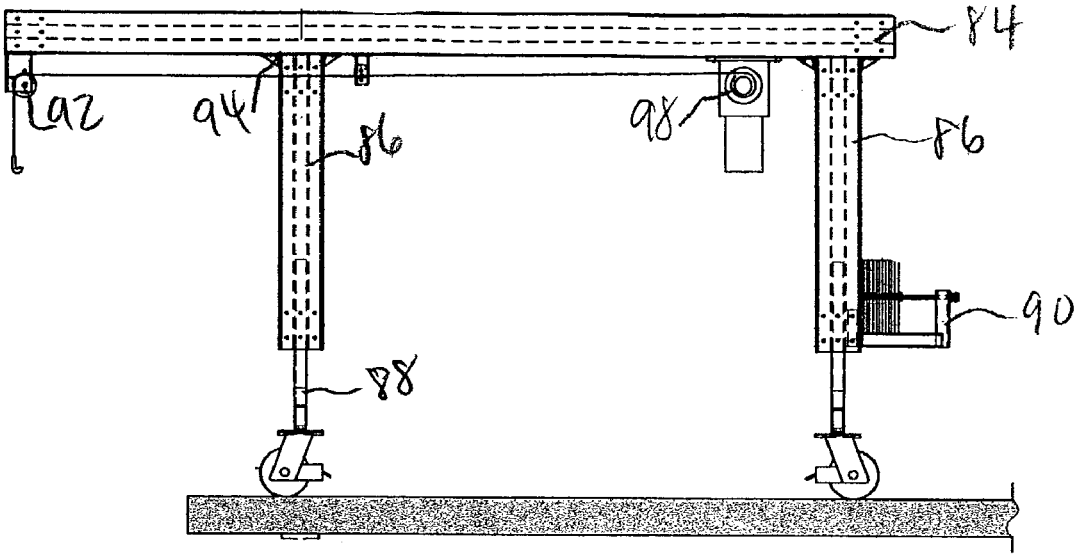
FIG. 13 is a side-elevational view schematically illustrating a mobile boom apparatus which may be assembled utilizing the modular structural components of the present invention.
Figure 14:
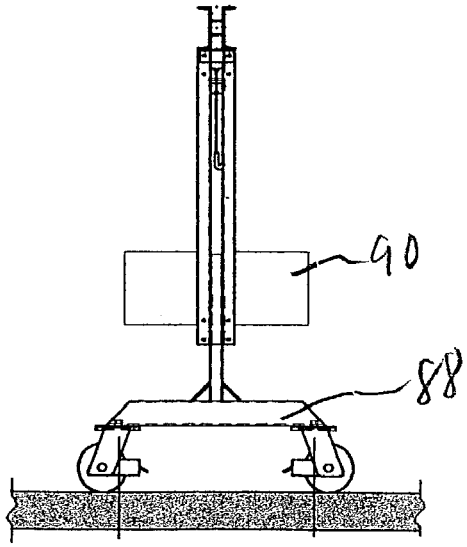
FIG. 14 is an end view of the apparatus shown in FIG. 13.
Figure 15:
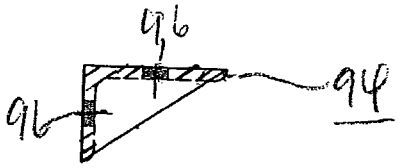
FIG. 15 is a cross-sectional end view of one embodiment of a connector plate which may be used to connect together, in a perpendicular relationship, two of the structural members shown in FIGS. 1-3, in accordance with the present invention.
Figure 16:
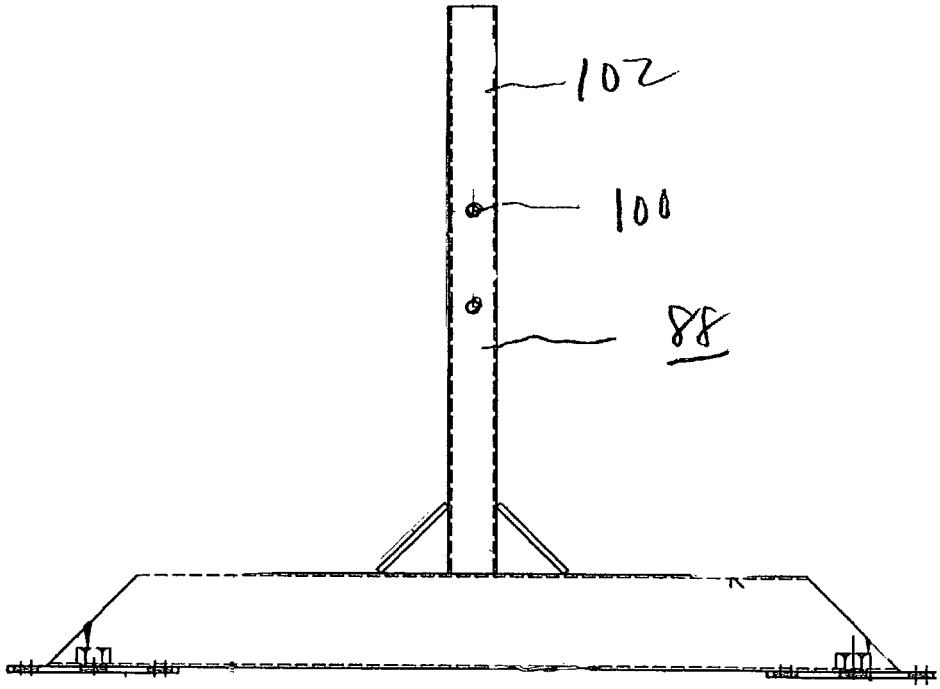
FIG. 16 is a more detailed view of the leg assembly schematically illustrated in FIG. 14, shown with the castor wheels removed.
Figure 17:
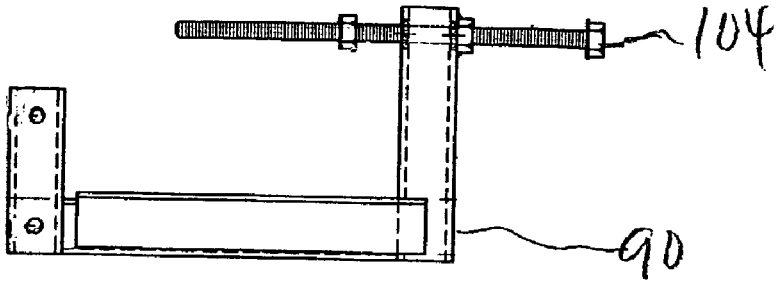
FIG. 17 is a more detailed view of the adjustable counterweight positioning mechanism schematically illustrated in FIG. 13, shown without the counterweights.
Figure 18:
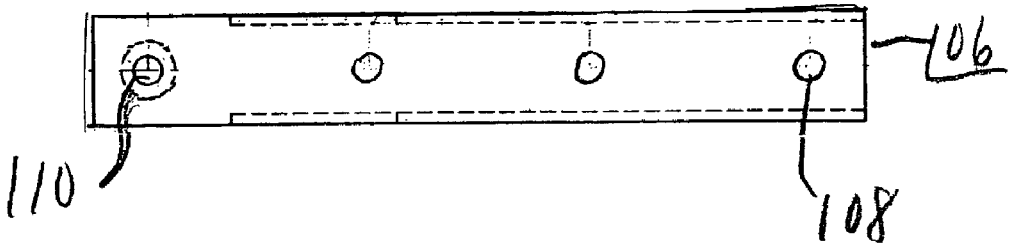
FIG. 18 is a side-elevational view schematically illustrating one embodiment of a hoist mount which may be disposed in the end of the boom apparatus shown in FIG. 13, as an alternative to or in conjunction with the pulley shown therein.

FIGS. 13 and 14 schematically illustrate a scaffolding boom which may be formed in a modular fashion from structural member 31 and associated components. In this arrangement, structural member 84, which may comprise the same structural member as 31, is connected in a perpendicular relationship with one or more structural members 86, which also can comprise structural member 31. The connection is made by means of bracket 94, which is illustrated in more detail in FIG. 15. As shown therein, bracket 94 comprises two joined, perpendicular plates with a web member at the end thereof. Bracket 94 has formed therein openings 96 which are configured so as to match openings 50, 52, and 54 of member 31, so that fasteners may be used therein to attach the adjoining members together. The boom shown may also utilize T-frame 88 for mounting purposes. Shaft 102 of T-frame 88 may have included therein openings 100 which, again, are chosen so as to match corresponding openings in member 31, and shaft 102 is further configured so as to slide into channel 44 of member 31. T-frame 88 may include castors as shown in FIG. 13 or the castors may be removed as shown in FIG. 16. The boom may further comprise counterweight mechanism 90, which, as shown in FIG. 17, may be adjusted in or out, thereby decreasing or increasing the counterweight force. Finally, the inventive boom may include pulley 92 and hoist 98 for raising and lowering loads. Alternatively, a hoist mount component, such as is illustrated in FIG. 18, may be inserted into the end of the boom, again through channel 44. In that arrangement, a hoist or other mechanism may be mounted at location 110.

It can be seen from the foregoing discussion that the structural member of the present, invention provides increased horizontal strength compared to conventional I-beams, while utilizing an equivalent amount of material. At the same time, the inventive structure incorporates elements which facilitate connection of the member to other like members, as well as to external structures and accessories. Furthermore, these same structural members may be utilized to form a "composite" beam system having increased strength, by assembling thereto removable, cooperating beam components. Hence, the present invention provides reusable modular components which may be readily combined to meet a variety of application requirements.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. An elongated structural member, comprising:

a pair of separated and opposed, generally co-planar top flanges, each extending throughout the length of said structural member;

a pair of separated and opposed, generally co-planar bottom flanges, each extending throughout the length of said structural member;

at least two web members, with at least one of said web members connecting the lowermost surface of one of said top flanges to the uppermost surface of one of said bottom flanges, and at least one of said web members connecting the lowermost surface of the other of said pair of top flanges to the uppermost surface of the other of said pair of bottom flanges, with each said web member connecting to its respective top and bottom flanges at a location intermediate of the outermost extents of said respective flanges, so as to form portions of said flanges which extend outwardly with respect to said web members; and at least one leg member disposed so as to connect said web members in a spaced-apart relationship with respect to each other.

2. The structural member of claim 1 wherein at least two of said web members extend throughout the length of said structural member.

3. The structural member of claim 2 wherein said at least one leg member extends throughout the length of said structural member.

4. The structural member of claim 3 wherein said at least one leg member comprises two leg members disposed so as to connect said web members in a spaced-apart relationship with respect to each other.

5. The structural member of claim 4 wherein at least two of said web members are further disposed so as to each extend generally perpendicularly between said top and bottom flanges, and wherein each said leg member is further disposed so as to extend generally perpendicularly between said at least two web members.

6. The structural member of claim 5 wherein said two web members and said two leg members are further disposed so as to form a central channel which extends throughout the length of said structural member and which has a rectangular cross-sectional shape, and so as to form two generally rectangularly-shaped slots which each extend throughout the length of said structural member, with one of said slots located above said central channel and the other located below said central channel.

7. The structural member of claim 1 wherein said bottom flanges are further disposed so that the uppermost surface of each said bottom flange slopes downwardly and outwardly with respect to said opposite bottom flange.

* * * * *